US005857495A

United States Patent [19]

Schwemmlein et al.

[11] Patent Number: 5,857,495

[45] Date of Patent: Jan. 12, 1999

[54] DEVICE FOR FORMING A DOUP FABRIC EDGE

[75] Inventors: Christoph Heinrich Oswald Schwemmlein, Borken-Weseke; Werner Bernhard Wanning, Südlohn; Karl-Heinz Seifer, Köln, all of Germany

[73] Assignee: Klocker-Entwicklungs-GmbH, Germany

[21] Appl. No.: 844,200

[22] Filed: Apr. 28, 1997

[30] Foreign Application Priority Data

| | | | |
|---|---|---|---|
| May 19, 1995 | [DE] | Germany | 195 18 427.0 |
| Jun. 3, 1995 | [DE] | Germany | 195 20 500.6 |
| Mar. 23, 1996 | [WO] | WIPO | PCT/EP96/01294 |

[51] Int. Cl.[6] ..... D03C 7/06

[52] U.S. Cl. ..... 139/54

[58] Field of Search ..... 139/54, 430

[56] References Cited

U.S. PATENT DOCUMENTS

| | | | |
|---|---|---|---|
| 3,561,496 | 2/1971 | Guallo | 139/54 |
| 3,794,083 | 2/1974 | Czelusniak | 139/54 |
| 4,108,213 | 8/1978 | Guttinger | 139/54 |
| 4,869,297 | 9/1989 | Van Bogaert et al. . | |

FOREIGN PATENT DOCUMENTS

| | | | |
|---|---|---|---|
| 0286619 | 10/1988 | European Pat. Off. . | |
| 0319182 | 6/1989 | European Pat. Off. . | |
| 0 519 550 | 12/1992 | European Pat. Off. | 139/54 |
| 2345544 | 10/1977 | France . | |
| 1816407 | 8/1969 | Germany . | |
| 3108662 | 9/1982 | Germany . | |
| 8505367 | 7/1985 | Germany . | |
| 4038256 | 6/1991 | Germany . | |
| 9636751 | 11/1996 | WIPO . | |

*Primary Examiner*—Andy Falik
*Attorney, Agent, or Firm*—Thomas R. Vigil

[57] ABSTRACT

The device for forming a fabric edge from two doup ends and one stationary thread comprises three guides for the doup ends and the stationary thread. The doup ends are twisted by the device after every second weft thread insertion. The thread guides for the doup ends and the thread guide for the stationary thread are arranged to pivot towards each other to form a shed between the doup ends on the one hand and the stationary thread on the other hand. The thread guides take the form of two needles to guide the doup ends and one needle for the stationary thread The two needles for the doup ends are parallel and spaced apart through a rotary support in such a way that the needle for the stationary thread can penetrate between the two needles for the doup ends.

9 Claims, 5 Drawing Sheets

DEVICE FOR FORMING A DOUP FABRIC EDGE

BACKGROUND OF THE INVENTION

1. Field of the Invention

The invention relates to a device for forming a fabric edge with two doup ends and one stationary thread in which there are thread guides for the doup ends and the stationary thread, the doup ends can be twisted together after every second weft insertion with the crossing of the stationary thread, the thread guides for the doup ends and the thread guides for the stationary thread are fitted to pivot towards each other to form a shed between the doup ends on the one hand and the stationary thread on the other.

2. Description of the Related Art Including Information Disclosed Under 37 CFR §§ 1.97–1.99

Devices for forming a doup edge are known in many different embodiments.

A device for forming a doup edge and provided with two doup ends and one stationary thread is known from DE-GM 85 05 367. In this case, the doup ends are guided by oblique slots for guiding the doup ends superposed crosswise in a connecting link and by a so-called stationary thread needle for receiving the stationary thread. The disadvantage of this device is that the threads have to be deviated.

Another device for forming a fabric edge is known from DE-OS 31 08 662; hereby a pivoting connecting link is provided, that receives the two doup ends. Above the pivoting connecting link a needle guides the stationary thread. The disadvantage thereof is that at least the stationary thread has to be deviated sharply at least twice.

DE 40 38 256 shows a similar construction; at least the stationary thread has to be sharply deviated twice in this construction too, so that the risk of thread breakage exists, depending on the thread used.

A device of the type specified above is known from U.S. Pat. No. 4,869,297. This device has a vertically placed needle with an eye at one end for guiding the stationary thread. Furthermore, two doup ends are provided which are guided through a trunk with two eyes. The space between the two eyes is such that the needle can penetrate between the two doup ends guided by the trunk. The trunk is rotatably designed for tying.

The disadvantage of this device is that the stationary thread is deviated sharply twice when reaching a final position, namely once, when the thread leaves the eye and the second time when the stationary thread is deviated through the trunk in the area of the lower end of the needle. This leads without fail to thread breakage, particularly where yarns of minor quality or glass fiber filaments are used.

SUMMARY OF THE INVENTION

Taking this prior art into consideration, the object of the present invention is to provide a device of the type mentioned above in which the threads used to form the fabric edge are not deviated in such a way as to lead to a thread breakage.

According to the invention, this object is achieved by having the thread guides take the form of needles to guide the doup ends or the stationary thread, whereby the two needles for the doup ends are parallel and spaced apart through a rotary support in such a way that the needle for the stationary thread can penetrate between the needles for the doup ends.

Thanks to the free space between the two needles, the other needle which receives the stationary thread, can penetrate between the two needles without the doup ends nor the stationary thread being deviated. That means that even problematic yarns or glass fiber filaments can be processed with the device according to the present invention.

The doup ends being in an open shed position are twisted together by means of the rotary support by pivoting the support, namely when the stationary thread and the doup ends are not crossed relative to each other, this position is called "open position" of the needles hereinafter. The "closed position" of the needles is the one when doup ends and stationary needle are crossed. That means that the twisting of the doup ends only occurs at every second change of shed. The advantage thereof is that thus the texture is less dense, i.e. less thick, as would be the case if twisting would occur at each change of shed and thus each weft thread would be tied.

By designing the thread guides as needles, another advantage becomes obvious: the threads can, e.g. after thread breakage, be pulled in without any problem by pushing a needle through the tube-shaped needle, by inserting the thread at the other end and by pulling it through the tube-shaped needle.

According to another characteristic of the invention, a separate actuation device is provided for the thread guides; in this case, the device works independently of the shaft. This actuation moves the thread guides independently of the shaft movement of the loom, offering thus the possibility of the weft thread being tied before the shanks reach their respective final position (closed or open position of the needles). Weft thread waste can thus be reduced. An actuation of the device by the heald shaft (actuation depending on the shaft) can also be conceived though. The actuation includes a swivel arm for receiving the rotary support and a swivel arm for the thread guide of the stationary thread. The swivel arms are pivotally connected to an actuated crankshaft by means of connecting rods. Such an actuation guarantees that the swivel arms and with them the thread guides arranged onto them are moving away from or towards each other respectively in a scissor-like movement when the shed opens or closes respectively, whereby a weft thread insertion occurs in every final position, that means in the open position as well as in the closed position.

According to another characteristic of the invention, an eccentric actuation is provided for the rotary support. To this purpose the support has an axis that traverses the swivel arm and that can be pivotally received by the swivel arm, whereby the axis has an eccentric disk at its end. The eccentric disk can be connected with a swivelling lever which can be actuated pivotally by means of a cam disk.

As already mentioned above, the rotary support can only be pivoted in the open position of the needles, not in their closed position. In order to guarantee this, the eccentric actuation is connected with the crankshaft preferrably in a transmission ratio of 1:2. That means that this transmission ratio guarantees that the twisting of the doup ends and thus a tying of the weft thread only occurs at every second change of shed, namely during the open position of the needles.

BRIEF DECRIPTION OF THE DRAWINGS

DESCRIPTION OF THE PREFERRED EMBODIMENT(S)

In the following the thread guides for the doup ends will be called doup end needles or doup end needle pair, respectively, and the thread guiding device for the stationary thread will be called stationary thread needle.

Figure 1:
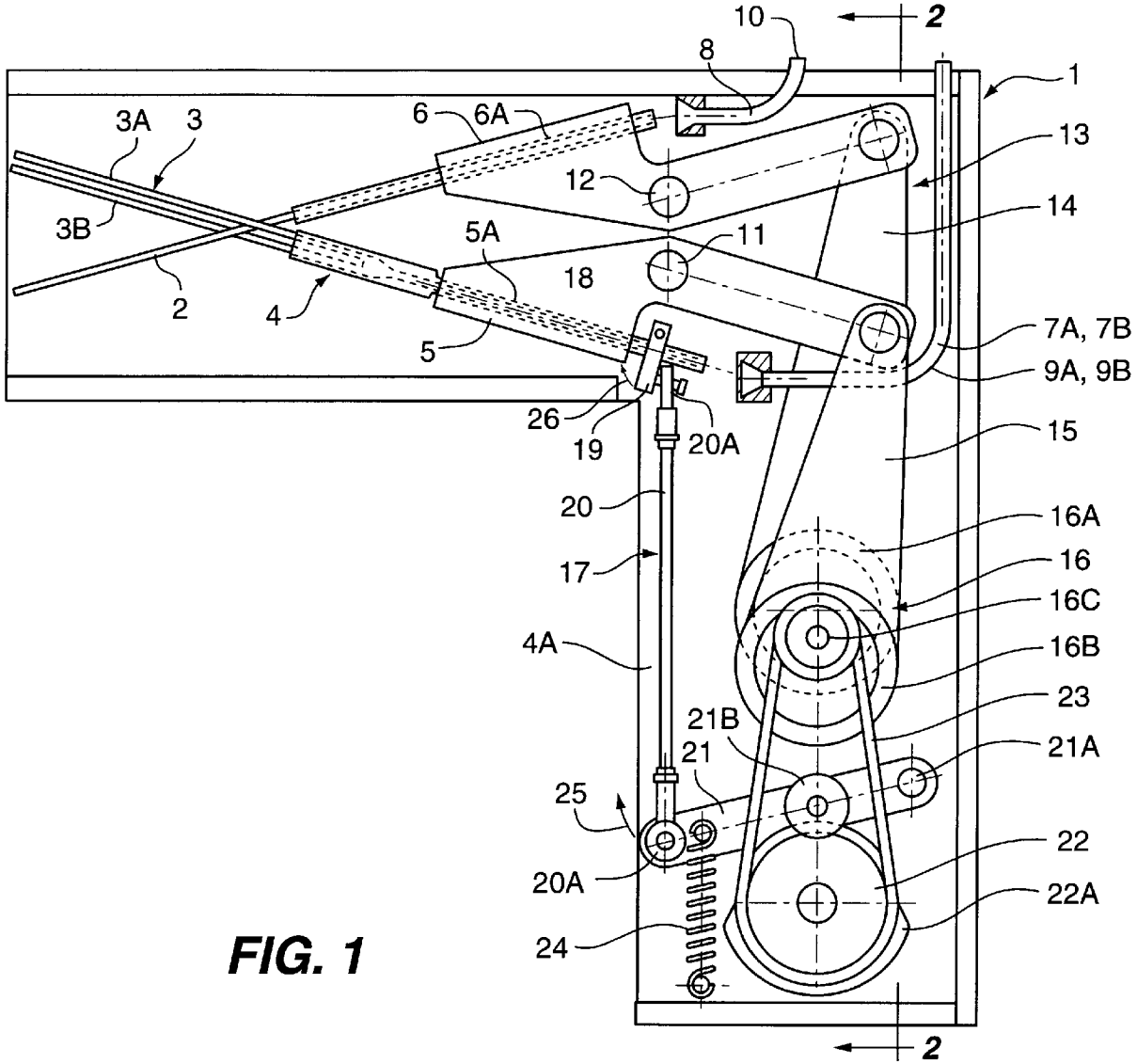
FIG. 1 is a lateral view of the whole device.
Figure 2:
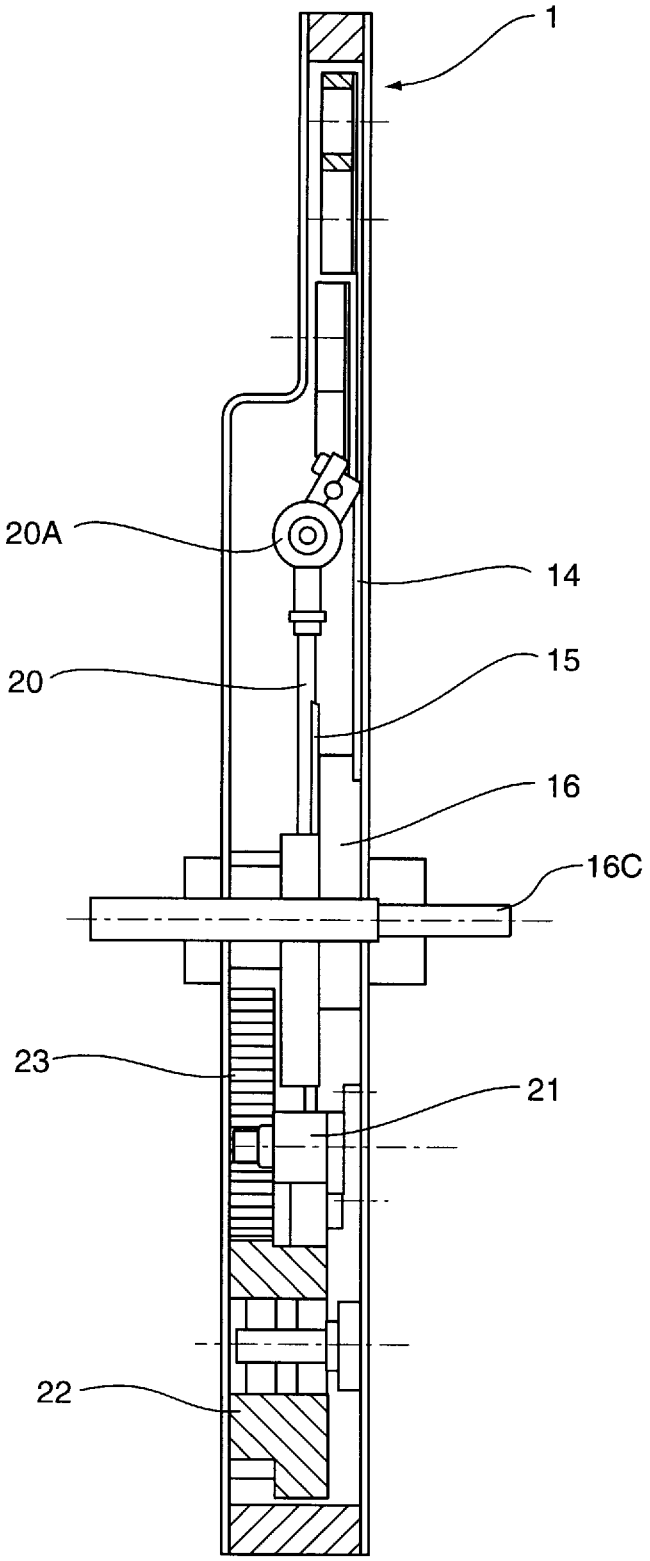
FIG. 2 is a section along the line II—II of FIG. 1, whereby possible bearings were omitted for more clearness.

In the device 1 with the housing 1*a* as shown in FIGS. 1 and 2, the stationary thread needle is referred to with numeral 2 and the doup end needle pair with numeral 3. The doup end needle pair 3 consists in the two doup end needles 3*a* and 3*b*. The doup end needle pair 3 is received by the rotary support referred to altogether with numeral 4. The stationary thread needle 2 is arranged relative to the doup end needle pair 3 in such a way that the stationary thread needle 2 can penetrate between the doup end needles 3*a*, 3*b*, as shown in FIG. 1. The actuation referred to altogether with numeral 13 includes the two swivel arms 5 and 6, which are pivotally arranged in the housing 1*a* by means of the swivel axes 11, 12. Each swivel arm 5 and 6 has a boring 5*a*, 6*a* for receiving the rotary support 4 or the stationary thread needle 2 resp., whereas the doup ends 2 or the stationary thread 8 resp. are guided to the respective needles through the support 4 or through the boring 6*a*. Thread guides 9*a*, 9*b* and 10 resp. are provided for guiding the doup ends 7*a*, 7*b* or the stationary thread 8 to the corresponding needles.

The swivel arms 5 and 6 are actuated by the connecting rods 14, 15, which are connected to the crankshaft referred to altogether with numeral 16. The crankshaft 16 has the two eccenters 16*a*, 16*b* that guarantee that the connecting rods 14, 15 arranged onto them are simultaneously moved towards or away from each other.

The rotary support referred to altogether with numeral 4 is connected with the eccentric actuation referred to altogether with numeral 17. The rotary support 4 has the hollow axis 18 received pivotally by the swivel arm 5 in boring 5*a*. The hollow axis 18 has at its end the eccentric disk 19. The hollow axis 18 also helps to guide the doup ends 7*a*, 7*b*. The connecting rod 20 is provided for the actuation of the eccentric disk and is connected with the swivelling lever 21. The connecting rod is connected with the eccentric disk on one hand and with the swivelling lever on the other by means of a socket joint 20*a*. The swivel arm 21 is pivotally supported by the axis 21*a* of the housing 1*a* and has the cam wheel 21*b*, which works together with the cam disk 22 with cam 22*a* in such a way that the swivelling lever 21 is ejected by the cam 22*a* of cam disk 22 by pivoting the cam disk. The cam disk 22 is driven by a belt 23. The belt 23 is actuated by a main drive pinion 16*c* provided on the crankshaft 16. The transmission ratio between the main drive pinion 16*c* and the cam disk 22 is 1:2. That means that the cam disk 22 only decribes half a revolution while the main drive pinion 16*c* describes a whole revolution. The ejected swivelling lever 21 is brought back into position by means of the restoring spring 24.

The device works in such a way that after each weft insertion the swivel arms 5, 6 are moved either towards (closed position of the needles) or away from each other (open position of the needles) by means of the connecting rods 14, 15. The twisting of the doup end needles 3*a*, 3*b* by the rotary support 4 only occurs in the position of the open shed, i.e. in the position, when the stationary thread needle 2 has not penetrated between the two doup end needles 3*a*, 3*b*. This also means that a twisting of the doup ends with the stationary thread crossing only occurs at every second weft insertion. It is in order to guarantee that such a twisting only occurs at every second weft insertion that the transmission between the main drive pinion 16*c* and the cam disk 22 was chosen at a ratio 1:2. As soon as the cam disk with cam 22*a* comes into the area of the cam wheel 21*b*, the swivelling lever 21 is ejected in direction of arrow 25. Hereby the eccentric disk 19 is horizontally swept out of the plane of projection in direction of arrow 26. The swivelling angle of the eccentric disk 19 comes hereby approximately to 180°.

Figure 3:
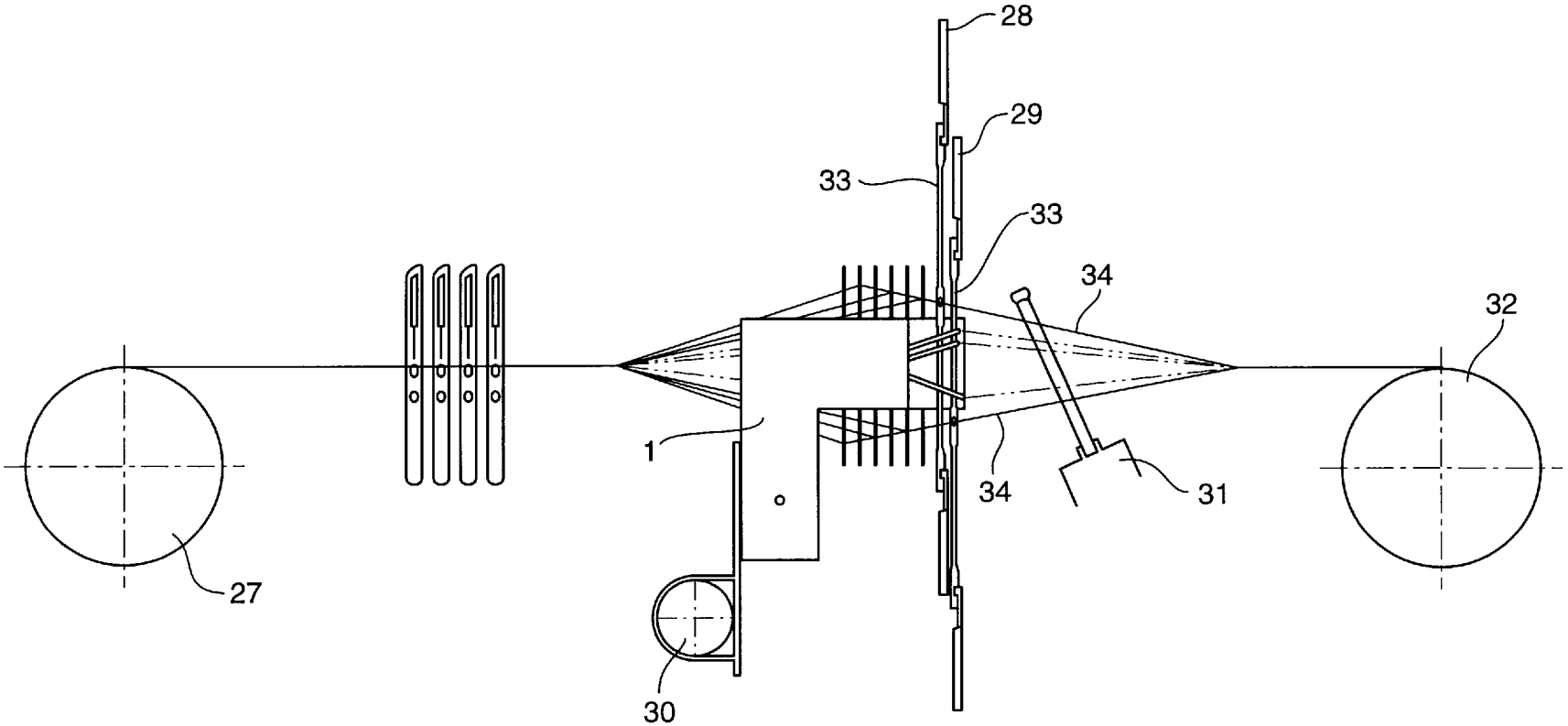
FIG. 3 is a plan view of a loom incorporating the fabric edge forming device of the present invention.

FIG. 3 shows the arrangement of the device as to the heald shafts. Seen from the loom beam 27, the device referred to with numeral 1 is placed in front of the heald shafts 28, 29 supporting the healds 33 for the beam threads 34. The device 1 is fastened onto the loom by means of the cross arm 30. The reed 31 for looping the weft thread (not shown) can also be seen in this drawing. The finished fabric is received by the fabric beam 32.

Figure 5:
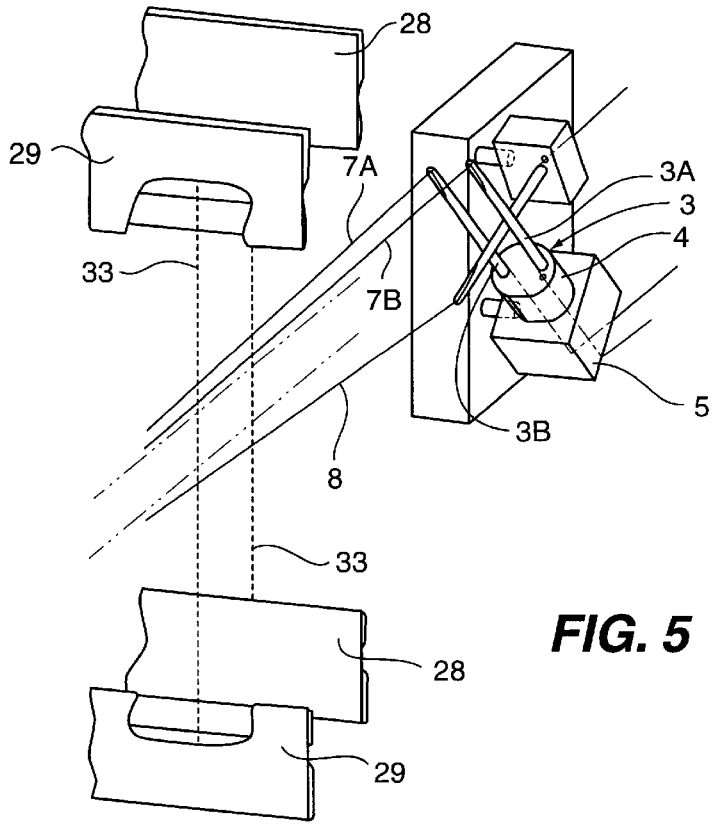
FIGS. 4 and 5 are a diagram of the tying procedure.
Figure 4:
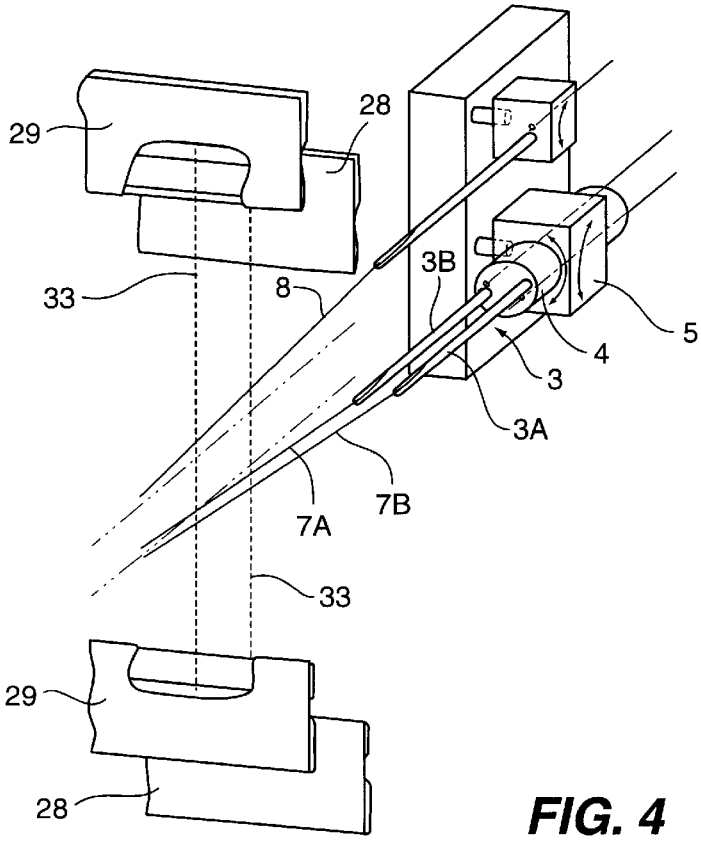

The twisting procedure of the doup ends 7*a*, 7*b* with the stationary thread 8 crossing and thus the formation of the fabric edge is explained in FIGS. 4 and 5, in which the whole device is only represented in a diagrammatic view. In the position of the doup end needles 3*a*, 3*b* relative to the stationary thread needle as shown in FIG. 4, the shed is open. After insertion of the weft thread (not shown), the rotary support 4 is swept horizontally by 180°. Thus, the two doup ends are twisted together with the weft thread being tied and the stationary thread crossing.

Thereupon, the needles are brought into the position shown in FIG. 5. After another weft insertion, the needles are brought back to the position shown in FIG. 4, followed by a rotation of the rotary support, whereas this time the rotation occurs in exactly the opposite direction, like in the first twisting procedure.

This results in a situation as shown in FIG. 5, in which only every second weft thread 35 is tied by a twisting of the two doup ends 7*a*, 7*b*, since in the position according to FIG. 5 the doup end needle pair 3 cannot be twisted.

Figure 6:
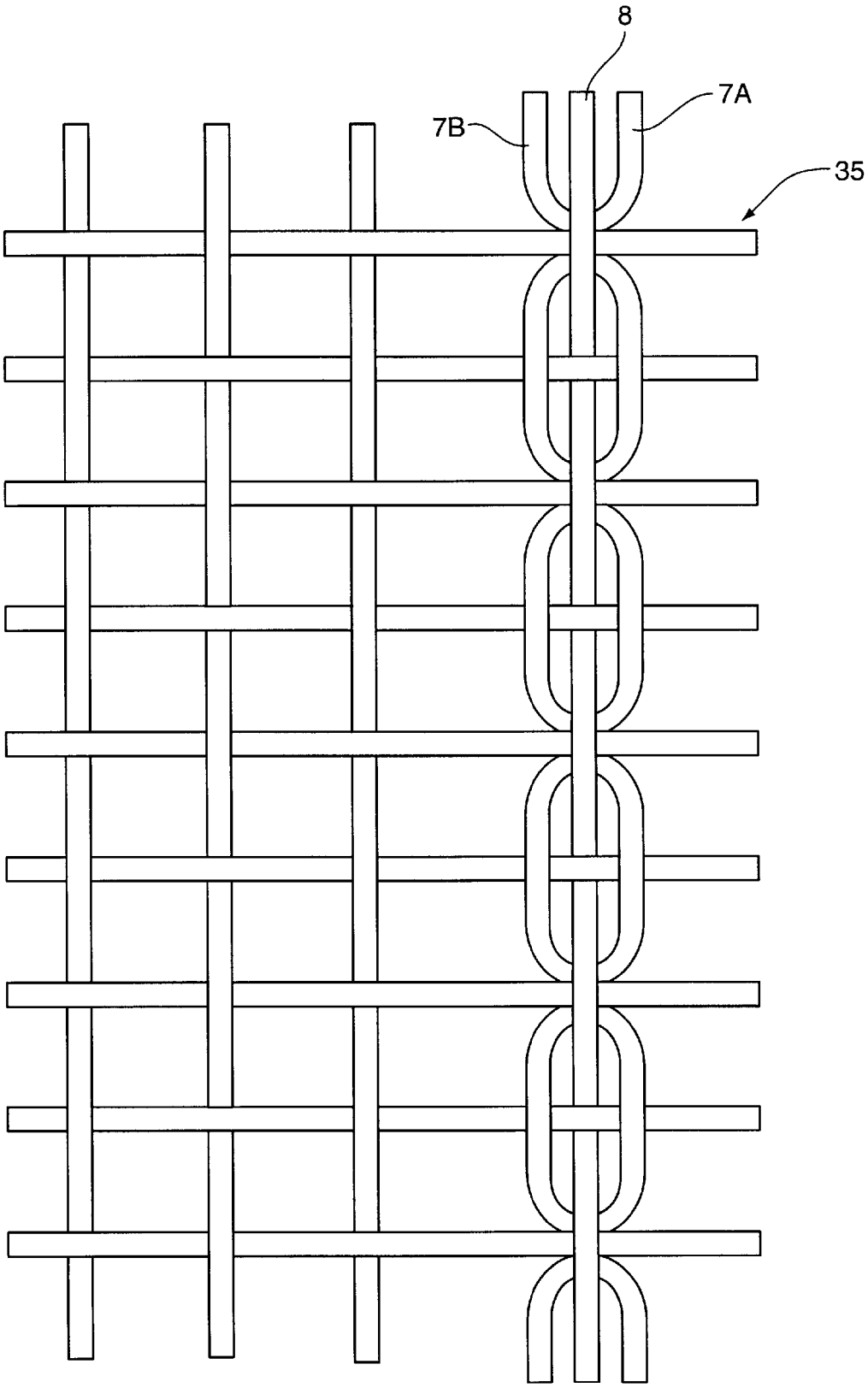
FIG. 6 shows the tying consisting in two doup ends and one stationary thread.

FIG. 6 shows two doup ends 7*a* and 7*b* placed about the stationary thread 8 and shows every second weft thread 35 tied by a twisting of (an overlay of) the doup ends 7*a* and 7*b* over the weft thread.

We claim:

1. Device for forming a fabric edge with two doup ends (7*a*, 7*b*) and one stationary thread (8) in which there are thread guides (3*a*, 3*b* or 2,) for the doup ends (7*a*, 7*b*) and the stationary thread (8), the doup ends (7*a*, 7*b*) can be twisted together after every second weft insertion with the crossing of the stationary thread (8), the thread guides (3*a*, 3*b* or 2,) for the doup ends (7*a*, 7*b*) and the thread guides (3*a*, 3*b* or 2,) for the stationary thread (8) are arranged to pivot towards each other to form a shed between the doup ends (7*a*, 7*b*) on the one hand and the stationary thread (8) on the other, characterized in that the thread guides (3*a*, 3*b* or 2) take the form of two needles (3*a*, 3*b*) to guide the doup ends (7*a*, 7*b*) and a needle (2) for the stationary thread (8), wherein the two needles (3*a*, 3*b*) for the doup ends are parallel and spaced apart through a rotary support (4) in such a way that the needle (2) for the stationary thread (8) can penetrate between the two needles (3*a*, 3*b*) for the doup ends (7*a*, 7*b*).

2. Device according to claim 1, characteized in that the needles (3*a*, 3*b* or 2) have the shape of a tube for guiding the doup ends or the stationary thread.

3. Device according to claim 1, characterized in that means (13, 17) are provided for moving the needles (2*a*, 3*a*, 3*b*).

4. Device according to claim 3, characterized in that means (13) for moving the needles includes a swivel arm (5) for the rotary support (4) and a swivel arm (6) for the needle (2) for the stationary thread (8).

5. Device according to claim 4, characterized in that two swivel arms (5, 6) are provided which can be swept horizontally by connecting rods (14, 15), and in that the connecting rods (14, 15) are connected with a crankshaft (16).

6. Device according to claim 1, characterized in that there is provided means (17) for moving the rotary support (4) in an eccentric path.

7. Device according to claim 6, characterized in that said rotary support (4) includes a swivel arm and a hollow axis (18) that traverses the swivel arm (15) and means for pivotally receiving the swivel arm (15), and in that the axis (18) has an eccentric disk (19) at its end, wherein the eccentric disk (19) can be connected with a swivelling lever (21) which can be actuated pivotally by means of a cam disk (22).

8. Device according to claim 1, characterized in that the rotary support (4) is adapted to be pivoted in the open position of the shed.

9. Device according to claim 3 wherein said needle moving means further includes an eccentric disk (19) on a crankshaft (16) and means (17) for moving the eccenctric disk connected with the crankshaft (16) in a transmission ratio of 1:2.

* * * * *

UNITED STATES PATENT AND TRADEMARK OFFICE

CERTIFICATE OF CORRECTION

PATENT NO. : 5,857,495

DATED : January 12, 1999

INVENTOR(S) : Christopher Schwemmlein et al.

It is certified that error appears in the above-indentified patent and that said Letters Patent is hereby corrected as shown below:

On the Title Page after:

"[22] Filed: Apr. 28, 1997

Foreign Application Priority Data

| | | | | |
|---|---|---|---|---|
| [30] | May 19, 1995 | [DE] | Germany..... | 195 18 427.0 |
| | Jun. 3, 1995 | [DE] | Germany..... | 195 20 500.0 |
| | Mar. 23, 1996 | [WP] | WIPO..... | PCT/EP96/01294" |

Should be:

--Related U.S. Application Data

[63] Continuation of PCT/EP96/01294, Mar. 23, 1996, published as WO 96/36751, Nov. 21, 1996

Foreign Application Priority Data

| | | | | |
|---|---|---|---|---|
| [30] | May 19, 1995 | [DE] | Germany..... | 195 18 427.0 |
| | Jun. 3, 1995 | [DE] | Germany..... | 195 20 500.0--; |

UNITED STATES PATENT AND TRADEMARK OFFICE

CERTIFICATE OF CORRECTION

PATENT NO. : 5,857,495

DATED : January 12, 1999

INVENTOR(S) : Christopher Schwemmlein et al

It is certified that error appears in the above-identified patent and that said Letters Patent is hereby corrected as shown below:

In the Abstract, line 10, after "thread" insert --.--.

Signed and Sealed this

Sixteenth Day of January, 2001

*Attest:*

*Attesting Officer*

Q. TODD DICKINSON

*Commissioner of Patents and Trademarks*